US011114765B2

(12) United States Patent
Yang

(10) Patent No.: US 11,114,765 B2
(45) Date of Patent: Sep. 7, 2021

(54) DIPOLE ANTENNA STRUCTURE

(71) Applicant: Shenzhen Antop Technology Co. Ltd., Guangdong (CN)

(72) Inventor: Ruidian Yang, Guangdong (CN)

(73) Assignee: SHENZHEN ANTOP TECHNOLOGY CO. LTD., Guangdong (CN)

( * ) Notice: Subject to any disclaimer, the term of this patent is extended or adjusted under 35 U.S.C. 154(b) by 0 days.

(21) Appl. No.: 16/713,699

(22) Filed: Dec. 13, 2019

(65) Prior Publication Data

US 2021/0098885 A1 Apr. 1, 2021

(30) Foreign Application Priority Data

Sep. 27, 2019 (CN) ..... 201921629949.2

(51) Int. Cl.
*H01Q 9/16* (2006.01)

(52) U.S. Cl.
CPC ..... *H01Q 9/16* (2013.01)

(58) Field of Classification Search
CPC ..... H01Q 9/16
See application file for complete search history.

(56) References Cited

U.S. PATENT DOCUMENTS 7,109,936 B2 * 9/2006 Mizoguchi ..... H01Q 1/243 343/702
7,218,288 B2 * 5/2007 Kimura ..... H01Q 1/246 343/793
7,439,926 B2 * 10/2008 Mikami ..... H01Q 7/00 343/789
7,692,599 B2 * 4/2010 Wong ..... H01Q 5/25 343/795
10,236,578 B2 * 3/2019 Nysen ..... H01Q 1/38
10,340,595 B2 * 7/2019 Kuo ..... H01Q 5/10

FOREIGN PATENT DOCUMENTS

CN 202839944 U 3/2013
JP 4870496 B2 2/2012

OTHER PUBLICATIONS

Sugiura et al. (Antenna, Aug. 11, 2006, the english translation of JP 4870496).*

* cited by examiner

*Primary Examiner* — Seung H Lee
(74) *Attorney, Agent, or Firm* — Muncy, Geissler, Olds & Lowe, P.C.

(57) ABSTRACT

The present invention provides a dipole antenna structure including a planar antenna element and a reflection plate which is directly under the planar antenna element. The planar antenna element includes a main radiator and secondary radiators. The main radiator is a rectangular metal sheet in which a rectangular opening and two convex portions are provided. A gap is provided between the two convex portions which bisect the rectangular opening into two rectangular portions of equal size, and the gap connects the two rectangular portions. The secondary radiators are arranged on the short sides of the planar antenna element. The antenna is simple in structure, convenient to produce and install, high in signal reception quality, wide in signal coverage, and can enhance signal reception in the UHF band to improve stability of the signal reception.

9 Claims, 5 Drawing Sheets

| Frequency (MHz) | Lobe Width | Front-to-back Ratio (dB) | First Upper-side Lobe | Maximum Beam | Out-of-roundness (dB) | Maximum Level | Minimum Level | First Lower Secondary |
|---|---|---|---|---|---|---|---|---|
| 550 | 87.89 | 5.42 | 5.42 | 266.8 | 13.28 | 7.37 | -19.19 | 5.42 |

| Frequency (MHz) | Gain (dB) | Minimum Gain (dB) | Co-polarization Maximum Gain (dB) | Cross-polarization Maximum Gain (dB) | Efficiency (dB) |
|---|---|---|---|---|---|
| 550 | 7.42 | -17.46 | 7.38 | -4.1 | 0.81 |

| Frequency (MHz) | Lobe Width | Front-to-back Ratio (dB) | First Upper-side Lobe | Maximum Beam | Out-of-roundness (dB) | Maximum Level | Minimum Level | First Lower Secondary |
|---|---|---|---|---|---|---|---|---|
| 600 | 93.95 | 4.01 | 4.02 | 266.28 | 15.73 | 6.61 | -24.84 | 4.02 |

| Frequency (MHz) | Gain (dB) | Minimum Gain (dB) | Co-polarization Maximum Gain (dB) | Cross-polarization Maximum Gain (dB) | Efficiency (dB) |
|---|---|---|---|---|---|
| 600 | 6.78 | -21.27 | 6.7 | -3.27 | 0.53 |

| Frequency (MHz) | Lobe Width | Front-to-back Ratio (dB) | First Upper-side Lobe | Maximum Beam | Out-of-roundness (dB) | Maximum Level | Minimum Level | First Lower Secondary |
|---|---|---|---|---|---|---|---|---|
| 650 | 97.24 | 1.96 | 0 | 274.12 | 25.34 | 5.48 | -45.2 | 1.98 |

| Frequency (MHz) | Gain (dB) | Minimum Gain (dB) | Co-polarization Maximum Gain (dB) | Cross-polarization Maximum Gain (dB) | Efficiency (dB) |
|---|---|---|---|---|---|
| 650 | 5.8 | -26.31 | 5.73 | -3.8 | 0.1 |

DIPOLE ANTENNA STRUCTURE

TECHNICAL FIELD

The present invention relates to the technical field of antennas, and specifically relates to a dipole antenna structure.

BACKGROUND ART

At present, a planar antenna has element type, slot type and other types, and is commonly characterized by being small in volume, light in weight, small in wind resistance and convenient to install and use. A built-in tuner integrates the antenna with the tuner to facilitate the adjustment. The planar antenna is high in efficiency, and is especially suitable for the reception of live satellite television. With the popularization of wireless digital television signals, more and more people receive television signals outdoors or on the move rather than being limited indoors. Even when watching television indoors, the antennas are needed to be installed at different positions in many environments. At this time, higher requirements are placed on the antennas which are tasked with signal reception: wide receiving frequency range, small occupied space, lightweight, being able to be installed in various environments and resistant to various weather, and strong signal receiving capabilities and the like.

However, the existing planar antennas still have drawbacks in the impedance of the element, the adaptation of the cable, and the cooperation of the element, the reflection plate and the antenna, and the like, thereby causing a loss situation in the signal transmission process and problems of unstable signal reception in the UHF band.

SUMMARY

The present invention aims to overcome at least one defect (deficiency) of the above prior art and to provide a dipole antenna structure so as to solve a problem of unstable signal reception in the UHF band.

The technical scheme according to the present invention is as follows.

A dipole antenna structure includes a planar antenna element and a reflection plate which is directly under the planar antenna element. The planar antenna element includes a main radiator and secondary radiators. The main radiator is a rectangular metal sheet in which a rectangular opening and two convex portions are provided. A gap is provided between the two convex portions which bisect the rectangular opening into two rectangular portions of equal size, and the gap connects the two rectangular portions. The secondary radiators are respectively arranged on the short sides of the planar antenna element.

The impedance of the planar antenna element can be adjusted by the shape and size of the rectangular opening so as to be adapted to the coaxial cable connected to the feed hole, match the impedance of the cable, and reduce the reflection loss effect in the signal transmission process. The combination with the secondary radiators can lengthen the element structure, improve the reception performance, enhance the signal reception on 470 to 520 MHz band, and improve the stability of the signal reception.

Preferably, the secondary radiators include four L-shaped radiators each of which extending outwardly from the four ends of the short sides respectively and bending and extending toward the central axis of the short side to form an L-shaped structure. The L-shaped structures of the L-shaped radiators save material while increasing the length, so that the length of the planar antenna element increases without becoming thick and heavy.

Preferably, the L-shaped radiators are bent and arranged at a preset angle relative to the main radiator, and the preset angle can be 30 to 90 degrees so as to realize the miniaturization of the planar antenna element.

Preferably, at least two metal strips are provided in any rectangular portion of the rectangular opening to divide the rectangular portion into a plurality of portions. The design of the metal strips can better control the impedance of the rectangular opening, so that the output impedance of the entire planar antenna element is adjusted.

Preferably, the reflection plate includes a bottom plate and bending structures on short sides and/or long sides thereof. The angle arrangement of the bending structure enables the reflection plate to better cooperate with the planar antenna element, so that the signal loss in the transmission process is reduced. More preferably, the number of metal strips is most preferably two, and the metal strips are also provided with positioning holes for better fixation.

Preferably, the long sides of the reflection plate are provided with grooves. The dipole antenna structure further includes two telescopic antennas to receive VHF signals. The antennas can be installed on the reflection plate combined with the grooves on the reflection plate in order to better receive signals in the VHF band.

Preferably, the main radiator is provided with positioning holes for better fixation in the antenna box. The middle sections of the long sides of the main radiator are provided with recessed portions, and the four corners of the rectangular opening are all provided with slits, so that the planar antenna element can be better combined with the reflection plate to be installed in the antenna box.

Preferably, the length of the long sides of the main radiator is 301±0.25 mm, and the length of the short sides is 110±0.15 mm.

Preferably, a joint connecting the gap and the rectangular portions is provided with chamfers, and the design can improve the safety degree when a worker installs and fixes the antenna element.

Compared with the prior art, the present invention can obtain some beneficial effects. the dipole antenna structure in the present invention is simple in structure, convenient to produce and install, high in signal reception quality, wide in signal coverage, and can enhance signal reception in the UHF band to improve stability of the signal reception.

DESCRIPTION OF EMBODIMENTS

Figure 1:
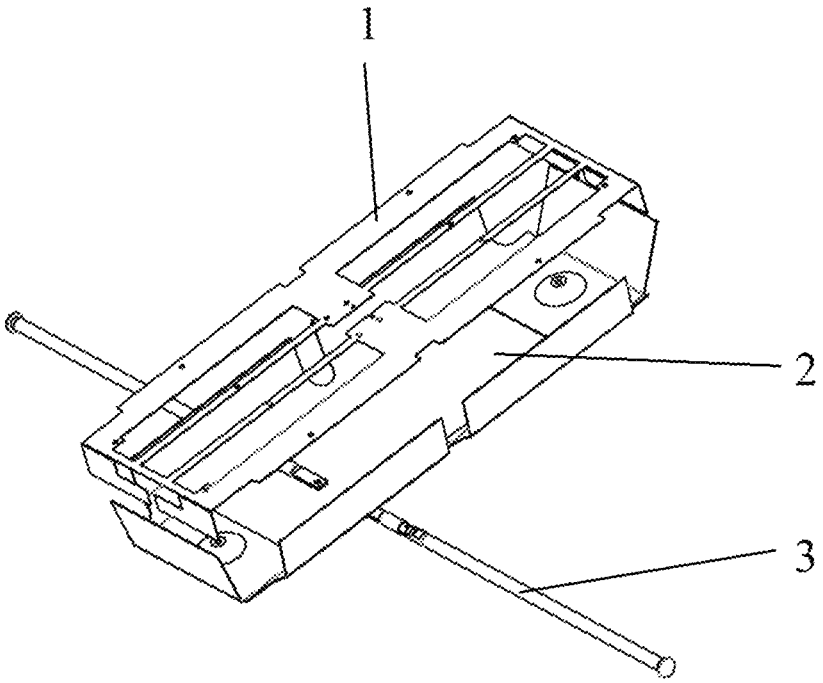
FIG. 1 is a structural schematic diagram of a dipole antenna structure of the present invention.

The drawings of the present invention are for illustrative purposes only and are not to be construed as limiting the present invention. In order to better illustrate the following embodiments, certain components of the drawings may be omitted, enlarged, or reduced, and do not represent the dimensions of the actual product. It will be understood that some known structures and descriptions thereof in the drawings may be omitted for those skilled in the art.

Figure 2:
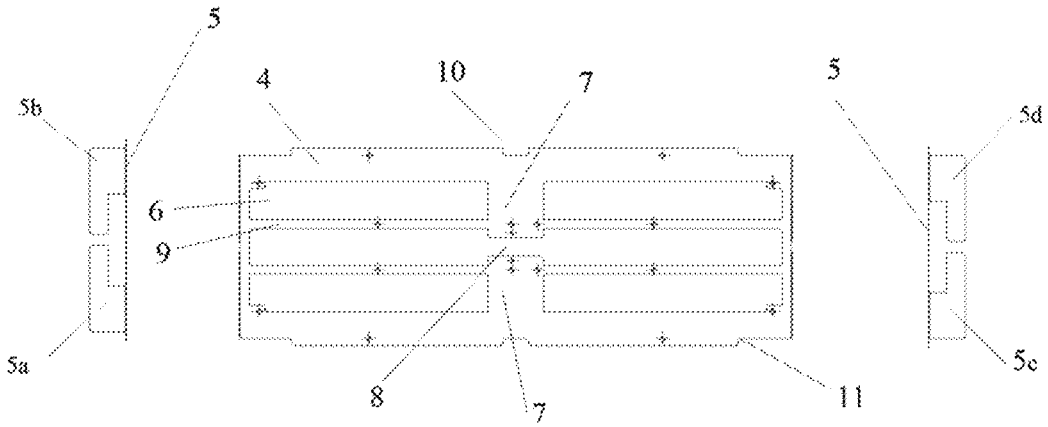
FIG. 2 is a schematic diagram of a planar antenna element of the present invention.

As shown in FIG. 1, the present embodiment is a dipole antenna structure including a planar antenna element 1, a reflection plate 2, and an antenna 3 receiving VHF signals. As shown in FIG. 2 which is a schematic diagram of the planar antenna element, the planar antenna element 1 includes a main radiator 4 and secondary radiators 5. The main radiator 4 is a rectangular metal sheet in which a rectangular opening 6 and two convex portions 7 are provided. The convex portions 7 bisect the rectangular opening 6 into two rectangular portions of equal size, and a gap 8 connects the two rectangular portions. The secondary radiators 5 are respectively arranged on both sides of the short sides of the planar antenna element 1.

Preferably, as shown in FIG. 2, the secondary radiators 5 include four L-shaped radiators 5*a*, 5*b*, 5*c* and 5*d* which extend outwardly from the four ends of the short sides respectively and bend and extend toward the central axes of the short sides to form L-shaped structures.

Preferably, the L-shaped radiators 5*a* to 5*d* can be bent at 30 to 90 degrees relative to the main radiator 4.

Preferably, as shown in FIG. 2, at least two metal strips 9 are provided in any rectangular portion of the rectangular opening 6 to divide the rectangular portion into a plurality of portions throughout the entire rectangular portion.

Preferably, as shown in FIG. 2, the middle sections of the long sides of the main radiator 1 are provided with recessed portions 10, and the four corners of the rectangular opening 6 are all provided with slits 11.

Preferably, as shown in FIG. 2, a joint connecting the gap 8 and the rectangular portions is provided with chamfers.

Figure 3:
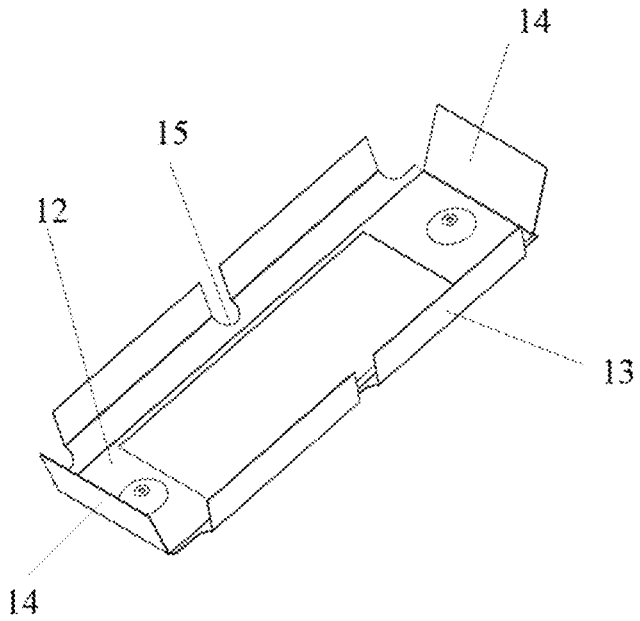
FIG. 3 is a schematic diagram of a reflection plate of the present invention.
Figure 4:
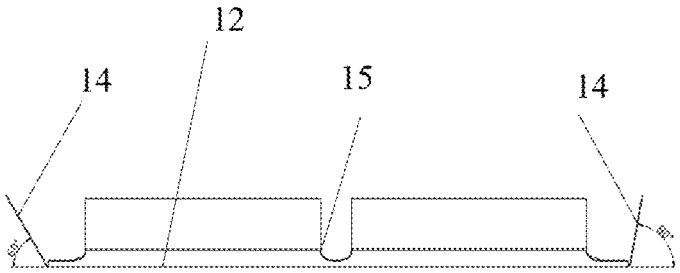
FIG. 4 is a structural schematic diagram of a side of the reflection plate of the present t invention.

Preferably, FIG. 3 is a structural schematic diagram of the reflection plate which includes a bottom plate 12 and bending structures 13 on long sides and bending structures 14 on short sides thereof. As shown in FIG. 4, the bending structures 14 on the short sides form acute angles with the bottom plate 12, and the formed acute angles can be the same or different.

Preferably, as shown in FIGS. 1, 3 and 4, the long side of the reflection plate is provided with a groove 15 through which the antenna 3 receiving the VHF signals can be installed and fixed between the reflection plate 2 and the planar antenna element 1.

Preferably, the length of the long sides of the main radiator is 301±0.25 mm, and the length of the short sides is 110±0.15 mm.

Preferably, the main radiator adopts a thick galvanized iron sheet with a thickness of 0.3±0.05 mm.

Figures 5, 6, 7:
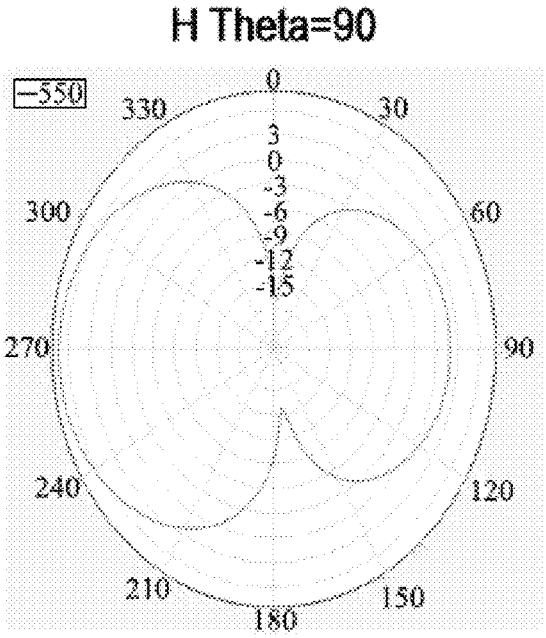
FIG. 5 is an antenna pattern of the present invention.
FIG. 6 is a data schematic diagram of the antenna pattern of the present invention.
FIG. 7 is a data schematic diagram of the antenna pattern of the present invention.

FIGS. 5, 6 and 7 show the test data of the planar antenna element when the frequency is 550 MHz. As can be seen from the data related to the antenna performance in FIGS. 6 and 7, the performance of the planar antenna element is good.

Figures 8, 9, 10:
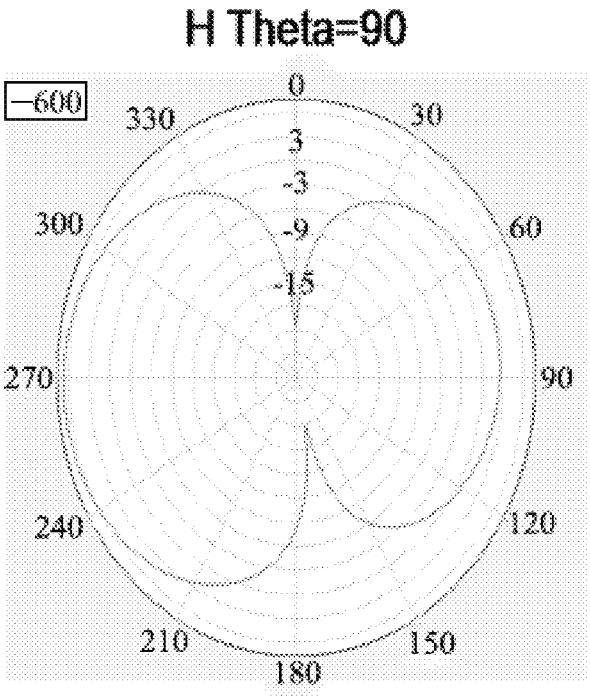
FIG. 8 is an antenna pattern of the present invention.
FIG. 9 is a data schematic diagram of the antenna pattern of the present invention.
FIG. 10 is a data schematic diagram of the antenna pattern of the present invention.

FIGS. 8, 9 and 10 show the test data of the planar antenna element when the frequency is 600 MHz. As can be seen from the data related to the antenna performance in FIGS. 9 and 10, the performance of the planar antenna element is good.

Figures 11, 12, 13:
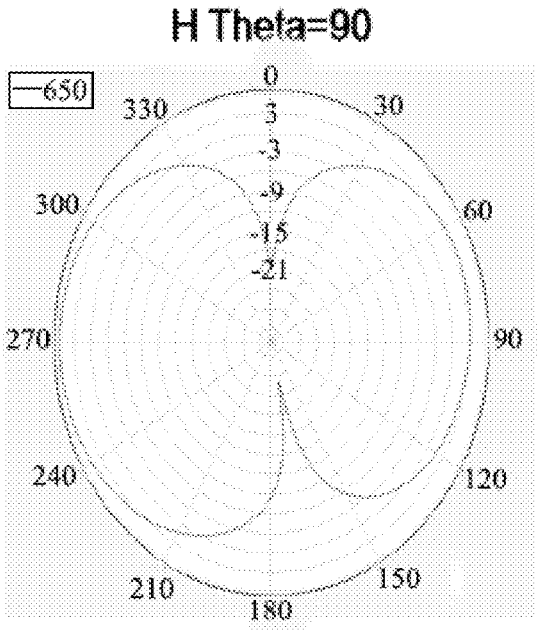
FIG. 11 is an antenna pattern of the present invention.
FIG. 12 is a data schematic diagram of the antenna pattern of the present invention.
FIG. 13 is a data schematic diagram of the antenna pattern of the present invention.

FIGS. 11, 12 and 13 show the test data of the planar antenna element when the frequency is 650 MHz. As can be seen from the data related to the antenna performance in FIGS. 12 and 13, the performance of the planar antenna element is good.

Obviously, the above embodiments of the present invention are merely examples for clear illustration of the invention, and are not intended to limit the implementation of the invention. Any modification, equivalent substitution or improvement and the like within the spirit and principle of the claims of the present invention should be included in the scope of claims of the present invention.

The invention claimed is:

1. A dipole antenna structure, comprising:

a planar antenna element; and a reflection plate, wherein the reflection plate is directly under the planar antenna element, the planar antenna element includes a main radiator and secondary radiators, the main radiator is a rectangular metal sheet in which a rectangular opening and two convex portions are provided, a gap is provided between the two convex portions which bisect the rectangular opening into two rectangular portions of equal size, the gap connects the two rectangular portions, and the secondary radiators are arranged on short sides of the planar antenna element, and wherein the secondary radiators include four L-shaped radiators each of which extends outwardly from four ends of the short sides respectively and bends and extends toward a central axis of a short side to form an L-shaped structure.

2. The dipole antenna structure according to claim 1, wherein the L-shaped radiators are bent and arranged at a preset angle relative to the main radiator.

3. The dipole antenna structure according to claim 1, wherein at least two metal strips are provided in any rectangular portion of the rectangular opening to divide the rectangular portion into a plurality of portions throughout the entire rectangular portion.

4. The dipole antenna structure according to claim 1, wherein the reflection plate includes a bottom plate and bending structures on short sides or long sides thereof.

5. The dipole antenna structure according to claim 1, wherein the long sides of the reflection plate are provided with grooves.

6. The dipole antenna structure according to claim 5, further comprising two telescopic antennas to receive VHF signals.

7. The dipole antenna structure according to claim 1, wherein middle sections of the long sides of the main radiator are provided with recessed portions, and four corners of the rectangular opening are all provided with slits.

8. The dipole antenna structure according to claim 1, wherein a length of the long sides of the main radiator is 301±0.25 mm, and a length of the short sides is 110±0.15 mm.

9. The dipole antenna structure according to claim 1, wherein a joint connecting the gap and the rectangular portions is provided with chamfers.

* * * * *